US008490689B1

(12) United States Patent
McClinton et al.

(10) Patent No.: US 8,490,689 B1
(45) **Date of Patent: *Jul. 23, 2013**

(54) BRIDGE STYLE FRACTIONATION PLUG

(71) Applicants: Tony D. McClinton, Odessa, TX (US); Stanley Keeling, Odessa, TX (US); Buster Carl McClinton, Odessa, TX (US)

(72) Inventors: Tony D. McClinton, Odessa, TX (US); Stanley Keeling, Odessa, TX (US); Buster Carl McClinton, Odessa, TX (US)

(73) Assignee: Tony D. McClinton, Odessa, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/774,684

(22) Filed: Feb. 22, 2013

Related U.S. Application Data

(60) Provisional application No. 61/602,019, filed on Feb. 22, 2012.

(51) Int. Cl.
*E21B 33/129* (2006.01)
*E21B 33/134* (2006.01)

(52) U.S. Cl.
USPC ..... 166/135; 166/179

(58) Field of Classification Search
USPC ..... 166/179, 118, 135, 196, 192
See application file for complete search history.

(56) References Cited

U.S. PATENT DOCUMENTS

| | | | | |
|---|---|---|---|---|
| 2,204,648 | A * | 6/1940 | Baker | 166/134 |
| 6,220,349 | B1 | 4/2001 | Vargus et al. | |
| 6,491,108 | B1 | 12/2002 | Slup et al. | |
| 6,581,681 | B1 | 6/2003 | Zimmerman et al. | |
| 6,796,376 | B2 | 9/2004 | Frazier | |
| 7,789,137 | B2 * | 9/2010 | Turley et al. | 166/138 |
| 8,079,413 | B2 | 12/2011 | Frazier | |
| D673,183 | S * | 12/2012 | Frazier | D15/21 |
| 8,336,616 | B1 * | 12/2012 | McClinton | 166/135 |
| 2007/0187085 | A1 * | 8/2007 | Dewey et al. | 166/55 |
| 2008/0060821 | A1 * | 3/2008 | Smith et al. | 166/387 |
| 2010/0132960 | A1 * | 6/2010 | Shkurti et al. | 166/387 |
| 2010/0155050 | A1 * | 6/2010 | Frazier | 166/102 |
| 2011/0036564 | A1 * | 2/2011 | Williamson | 166/188 |
| 2011/0240295 | A1 * | 10/2011 | Porter et al. | 166/308.1 |

* cited by examiner

*Primary Examiner* — Daniel P Stephenson
(74) *Attorney, Agent, or Firm* — Buskop Law Group, PC; Wendy Buskop

(57) ABSTRACT

A bridge style fractionation plug for use in a wellbore to separate a lower fractionation zone from an upper fractionation zone with no communication between the zones.

7 Claims, 8 Drawing Sheets

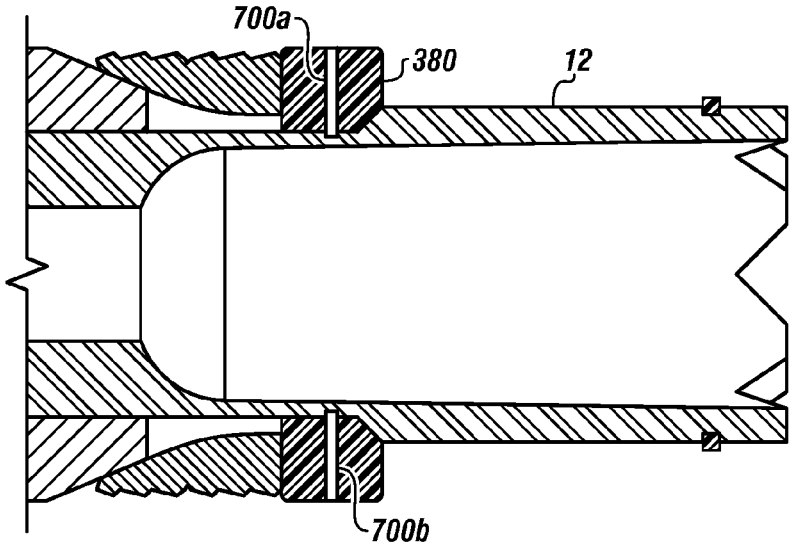
FIGURE 6
FIGURE 7
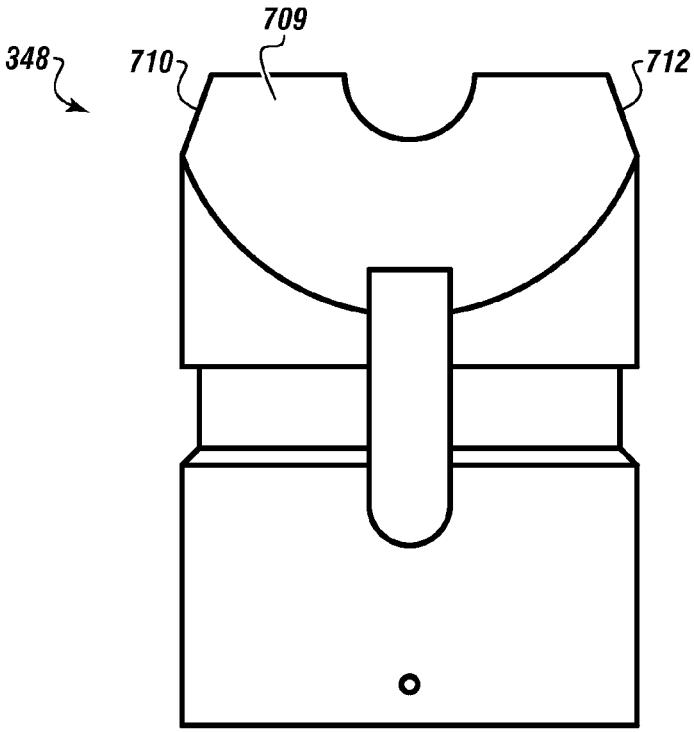

BRIDGE STYLE FRACTIONATION PLUG

CROSS REFERENCE TO RELATED APPLICATION

The current application claims priority to and the benefit of U.S. Provisional Patent Application Ser. No. 61/602,019 filed Feb. 22, 2012, entitled "BRIDGE STYLE FRACTIONATION PLUG". This reference is incorporated in its entirety.

FIELD

The present embodiments generally relate to a bridge plug for use in isolating fractionation zones in a wellbore.

BACKGROUND

A need exists for a fractionation plug which can avoid being preset in the wellbore while simultaneously separating the wellbore into separate zones.

A further need exists for a fractionation plug that can quickly and securely engage with the crown of another fractionation plug, which can prevent fractionation plugs from spinning during drill-out.

The present embodiments meet these needs.

BRIEF DESCRIPTION OF THE DRAWINGS

The detailed description can be better understood in conjunction with the accompanying drawings as follows:

FIG. 6 depicts a cross sectional view of a load ring disposed about a mandrel wherein one or more set screws are disposed through the load ring.

FIG. 7 depicts a tapered nose cone having a beveled distal end.

Figure 1A:
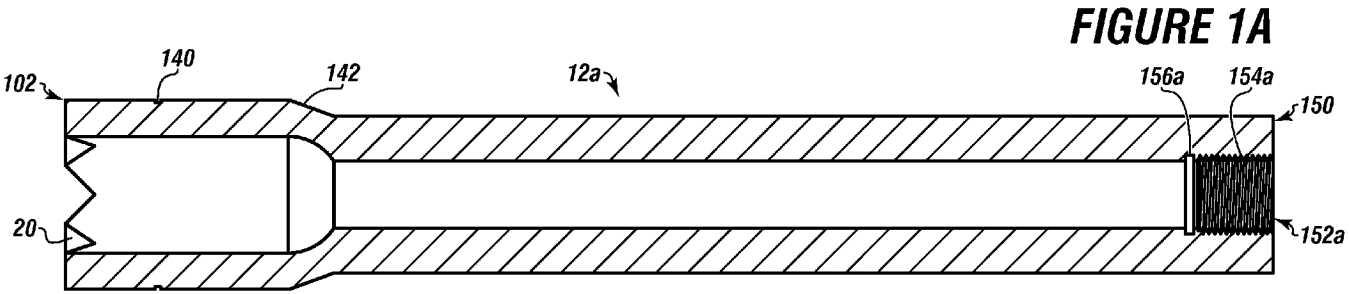
FIG. 1A depicts a mandrel according to one or more embodiments.

The present embodiments are detailed below with reference to the listed figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to a bridge style fractionation plug.

The bridge style fractionation plug can be used in a wellbore and can include a mandrel.

An embodiment of the bridge type fractionation plug allows a work over team to pressure up on wellbore casing before perforating a fractionation zone to ensure that the plug is holding; enabling successful separation of two fractionation zones.

The bridge type fractionation plug does not allow fractionation fluids, sand, or chemicals to penetrate a zone below the bridge plug; preventing loss of fractionation fluids, thereby insuring maximum fractionation in the correct fractionation zone.

These plugs can be used for cement jobs in the wellbore due to the solid construction of the bridge plug.

The mandrel can include a crown engagement and a setting mechanism receiving end.

The crown engagement can have a diameter larger than the setting mechanism receiving end.

A mandrel shoulder can be formed between the crown engagement and the setting mechanism receiving end. A load ring can rest on the mandrel shoulder.

A first slip can be adjacent to the load ring. A first slip backup can be adjacent to the first slip. A first lubricating spacer can be adjacent to the first slip backup and a first secondary seal.

A primary seal can be adjacent to the first secondary seal. A second secondary seal can be adjacent to the primary seal.

A second lubricating spacer can be adjacent to the second secondary seal, which can include a second slip backup adjacent to the second lubricating spacer. The second slip can be adjacent to the second slip backup.

A removable nose cone can be disposed over the mandrel and can be adjacent to the second slip backup.

The removable nose cone can include a double bevel or tapered engagement. The tapered engagement can be composed of a first sloped face, a second sloped face, and a tapered face.

A central annulus can be formed in the center of the sloped faces of the tapered engagement. The tapered engagement can be integrated with a nose cone body which can form a pump down ring groove.

An embodiment can include a plurality of pressure relief grooves which can extend longitudinally. The pressure relief grooves can be disposed on an outer surface of the tapered engagement.

A facial seal can be formed in the setting mechanism receiving end of the mandrel where a bridge plug setting mechanism can be threaded into the setting mechanism receiving end between the facial seal and the removable nose cone.

The bridge plug setting mechanism can include a setting mechanism body which can engage the facial seal. The bridge plug setting mechanism can also include a setting mechanism load shoulder.

An extension can extend from the setting mechanism load shoulder into the removable nose cone. For example, in one or more embodiments the extension can be about 0.47 inches long from the setting mechanism load shoulder to the face of the extension.

Engaging threads can extend over an outer surface of the setting mechanism body. The engaging threads can extend at least a portion of the setting mechanism body.

The engaging threads can screw into the internal threads of the bridge plug setting mechanism receiving end.

The setting mechanism body can include a first bridge plug setting mechanism chamber with a first diameter and a second bridge plug chamber with a second diameter. The engaging threads can extend into a portion or the entire first bridge plug setting mechanism chamber.

The second diameter can be larger than the first diameter, which can create a bridge plug shoulder. For example, in one or more embodiments the first diameter can be 0.95 inches and the second diameter can be 1.145 inches.

Shear threads can be formed inside the second bridge plug chamber. Shear threads can allow for threadable connection between the setting mechanism and a setting tool, such as a wireline setting tool.

The bridge style fractionation plug can include a crown engagement that can be detachable from the mandrel. The crown engagement can have a plurality of grooves in the top portion, such as from about four grooves to about six grooves. The grooves can provide a secure engagement with the nose cone of an adjacent plug.

The bridge style fractionation plug can include a setting mechanism with left handed threads. The left handed threading can be used to prevent loosening of the bridge plug, such as when the setting tool is inserted and tightened into the second bridge plug setting mechanism chamber.

The bridge style fractionation plug can include a mandrel. A mandrel can be composed of a metal, a non-metallic composite, or combinations thereof, such as a mandrel made from a glass and resin composite.

The bridge style fractionation plug can include slips made from a metal, non-metallic, composite, or combinations thereof.

Turning now to the Figures, FIG. 1A depicts a mandrel according to one or more embodiments.

The mandrel 12*a* can be used to form a portion of the bridge fractionation plug.

The mandrel 12*a* can have a first end 102 and a second end 150. The mandrel 12*a* can have an overall length from 1 foot to 4 feet. The outer diameter of the mandrel 12*a* can be from 2 inches to 10 inches.

The mandrel 12*a* can have a crown engagement 20 formed in the first end 102.

The first end 120 can have a first diameter that is larger than a second diameter of the second end 150. For example, in one or more embodiments, the first diameter can be 0.75 inches and the second diameter can be 2.25 inches.

A mandrel shoulder 142 can be formed between the first end 102 and the second end 150. The mandrel shoulder 142 can be of varying angles, such as from about 10 degrees to about 25 degrees.

The second end 150 can have a first setting mechanism receiving portion 152*a*, which can have a facial seal 156*a* and first internal threads 154*a*. The facial seal can be made from an elastomer, urethane, TEFLON™ brand polytetrafluoroethylene, or similar durable materials. The facial seal 156*a* can be one or more O-rings, E-rings, C-rings, gaskets, end face mechanical seal, or combinations thereof. The first setting mechanism receiving portion 156*a* can be used when the operating pressure is less than 8,000 psi.

An anti-rotation ring groove 140 can be formed into the first end 102. The anti-rotation ring groove 140 can secure an anti-rotation ring, not shown in this Figure, about the mandrel 12*a*. The anti-rotation groove prevents the fractionation plug from becoming loose and falling off of a plug setting tool. The anti-rotation groove creates a tight fit between the anti-rotation seal and the fractionation plug setting sleeve. The anti-rotation ring can be made from elastomeric, TEFLON™ brand polytetrafluoroethylene, urethane, or a similar sealing material that is durable and able to handle high temperatures.

Figure 1B:
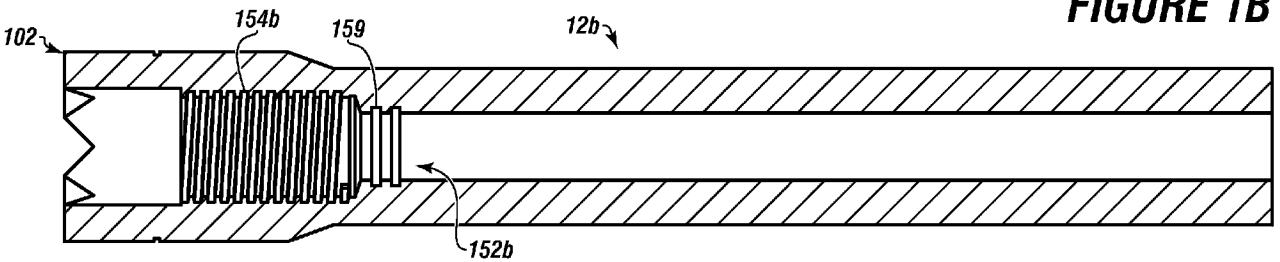
FIG. 1B depicts another mandrel according to one or more embodiments.

FIG. 1B depicts another embodiment of a mandrel 12*b*. The mandrel 12*b* can be substantially similar to the mandrel 12*a*. The mandrel 12*b*, however, can have a second setting mechanism receiving portion 152*b* formed adjacent to the first end 102. The second setting mechanism receiving portion 152*b* can have one or more seals 159. The second setting mechanism receiving portion 152*b* can have one or more second internal threads 154*b*. The second setting mechanism receiving portion 152*b* can be used at any pressure.

Figure 1C:
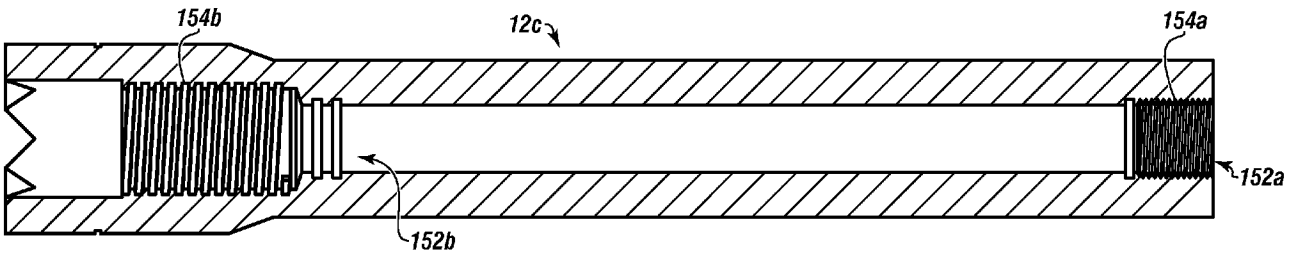
FIG. 1C depicts an additional mandrel according to one or more embodiments.

FIG. 1C depicts another embodiment of a mandrel 12*c*. The mandrel 12*c* can be substantially similar to the mandrel 12*a*, but can include the first setting mechanism receiving portion 152*a* and the second setting mechanism receiving portion 152*b*. The first setting mechanism receiving portion 152*a* can have first internal threads 154*a*. The second setting mechanism receiving portion can have second internal threads 154*b*.

Figure 2:
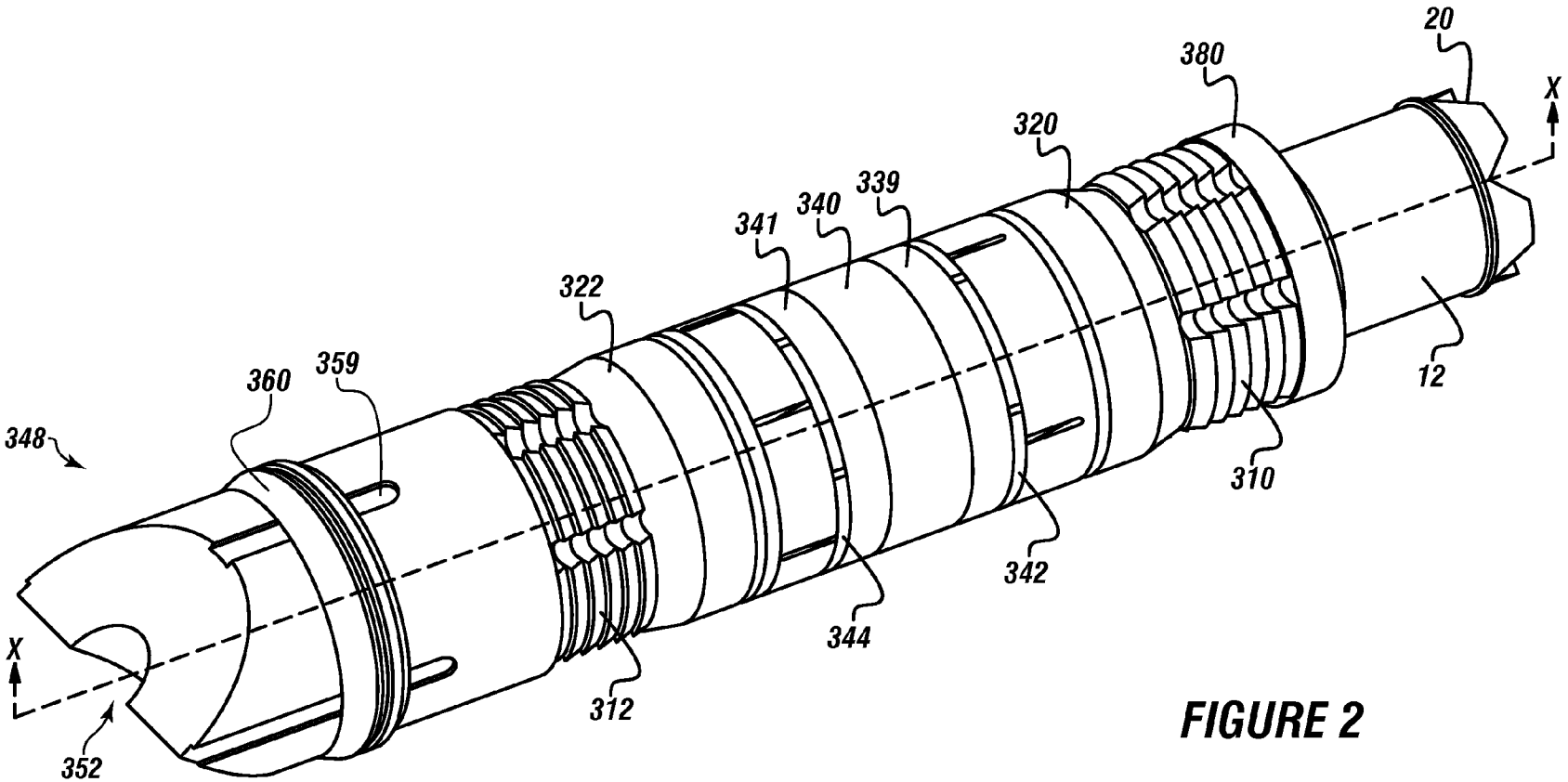
FIG. 2 is a perspective view of a fractionation plug according to one or more embodiments.

FIG. 2 is an isometric view of an illustrative fractionation plug according to one or more embodiments.

The fractionation plug can include a mandrel 12, which can be any mandrel described herein. One or more slips, such as a first slip 310 and a second slip 312 can be disposed on the mandrel 12.

The slips 310 and 312 can be made from metallic or non-metallic material. The slips 310 and 312 can have segments that bite into the inner diameter of a casing of a wellbore. The first slip 310 can be adjacent a load ring 380, and the second slip 312 can be adjacent a removable nose cone 348. The first slip 310 and the second slip 312 can be bidirectional slips, unidirectional slips, or any other slip configured that are used in downhole operations.

The mandrel 12 can also have one or more slip backups disposed thereon. A first slip backup 320 can be adjacent to the first slip 310. At least a portion of the first slip backup 320 can be tapered to at least partially nest within a portion of the inner diameter of the first slip 310. A second slip backup 322 can be adjacent the second slip 312. At least a portion of the second slip backup 322 can be tapered to at least partially nest within a portion of the inner diameter of the second slip 312. The slip backups can force the adjacent slip to expand into the inner diameter of the casing of the wellbore.

The slip backups can expand the first secondary seal 339, the second secondary seal 341, and the large primary seal 340. These seals can be made of any sealing material. Illustrative sealing material can include rubber, elastomeric material, composite material, or the like. These seals can be configured to withstand high temperatures, such as from 180 degrees Fahrenheit to 450 degrees Fahrenheit.

A first lubrication spacer 342 and a second lubrication spacer 344 can be disposed on the mandrel 12. The lubrication spacers can be made of a material that can allow free movement of the adjacent components such as TEFLON™ brand polytetrafluoroethylene, plastic, polyurethane. The first and second lubrication spacers are each tapered on one side and fit into the slip backups. The first and second lubrication spacers can range in length from 1 inch to 3 inches.

The first lubrication spacer 342 can be disposed adjacent the first slip back up 320. The first lubrication spacer 342 can be disposed between the first slip back up 320 and the first secondary seal 339.

The second lubrication spacer 344 can be disposed about the mandrel 12 adjacent the second slip backup 322. The second lubrication spacer 344 can be disposed between the second secondary seal 341 and the second slip backup 322.

The mandrel 12 can also have a removable nose cone 348 disposed thereon. The removable nose cone 348 can have one or more pressure relief grooves 359 formed therein. The removable nose cone 348 can be of various lengths and have faces of various angles. The removable nose cone can be 6 inches long and can have a first sloped face of 45 degrees and a second sloped face of 45 degrees tapering to a point together. The removable nose cone 348 can have a central annulus 352. The diameter of the central annulus can range from ⅝ of an inch to 3 inches. The removable nose cone 348 can be disposed about or connected with the mandrel 12 opposite the crown engagement 20. A pump down ring 360 can be disposed about the removable nose cone 348.

The load ring 380 can be disposed about the mandrel 12 adjacent or proximate to the crown engagement 20. The load ring 380 can reinforce a portion of the mandrel 12 to enable the mandrel 12 to withstand high pressures. The load ring 380 can be made from a composite material containing glass and epoxy resin or polyamide cured material that is able to be machined, milled, cut, or combinations thereof. The load ring can be from 1 inch to 3 inches in length and 2 inches to 8 inches in diameter.

Figure 3:
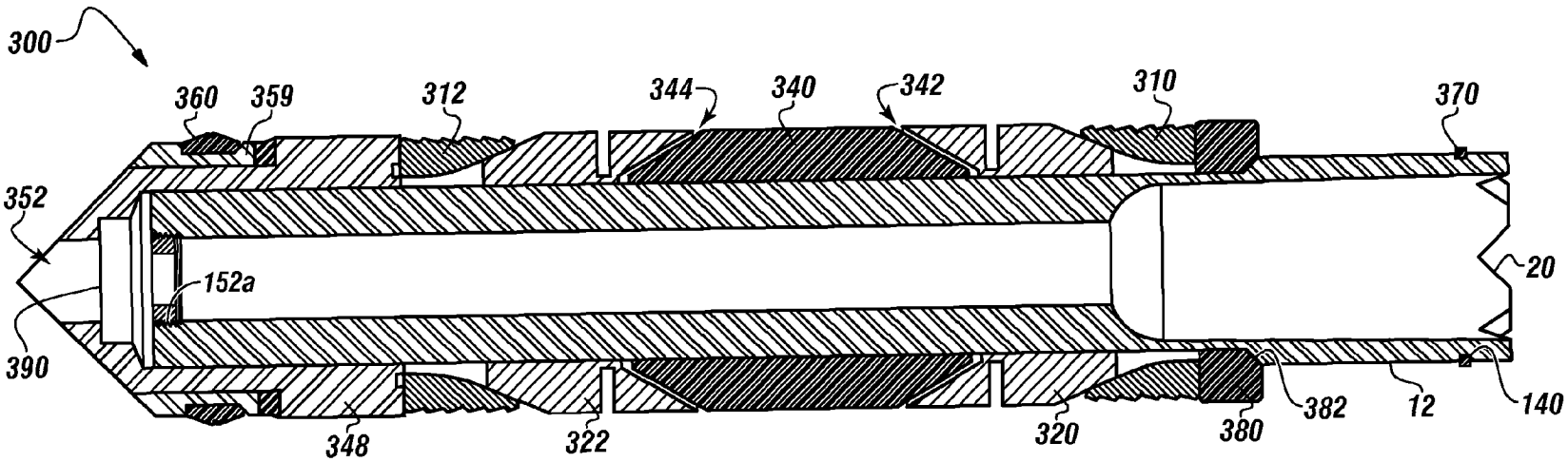
FIG. 3 is a cut view of the fractionation plug of FIG. 2 along line X-X.

FIG. 3 is a cut view of the fractionation plug of FIG. 2 along line X-X.

The fractionation plug 300 can have the mandrel 12. The mandrel 12 can have a first setting mechanism receiving portion 152*a*.

A setting mechanism 390 can be inserted in the first setting mechanism receiving portion 152*a*. The setting mechanism can have a solid portion. The setting mechanism can threadably connect to the first setting mechanism receiving portion 152*a*. The setting mechanism 390 can be any setting mechanism, such as those described herein.

The removable nose cone 348 can be supported by the mandrel, the setting mechanism 390, or any combination thereof.

An anti-rotation ring 370 can be secured in the anti-rotation ring groove 140.

The load ring 380 can rest on a mandrel a load ring seat 382 adjacent the load shoulder.

Also shown are pump down ring 360, the pump down ring groove 359, the first slip 310, the second slip 312, the first slip backup 320, the second slip backup 322, a large primary seal 340, the first lubrication spacer 342, the second lubrication spacer 344, and the central annulus 352.

The crown engagement 20 is also viewable in this Figure. The crown can be integral with the mandrel 12 as a one piece structure. In an embodiment, such as the 4½ inch in diameter mandrel, the crown can have 6 grooves formed by 6 points that extend away from the mandrel 12, creating an engagement that securely holds another nose cone to the plug for a linear connection of two plugs in series.

Figure 4A:
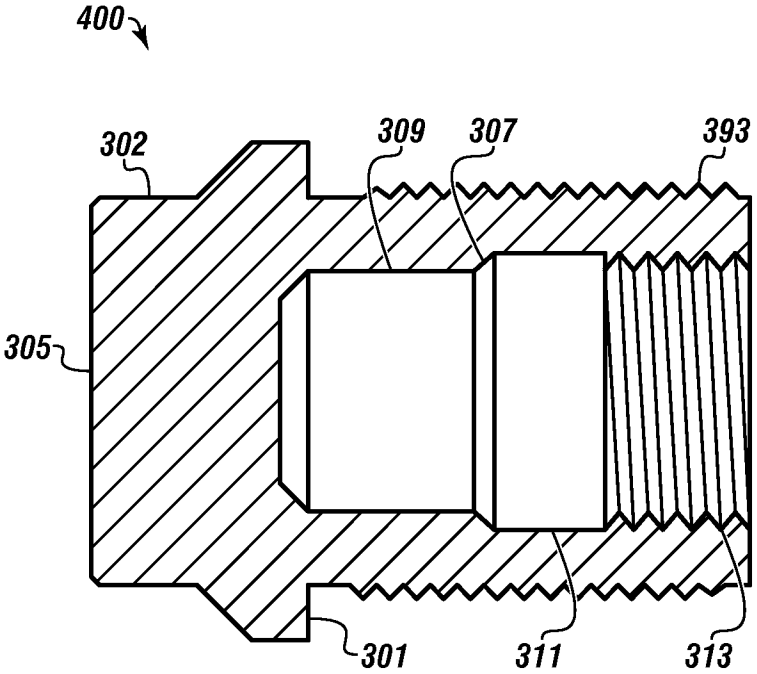
FIG. 4A depicts a schematic of a first setting mechanism according to one or more embodiments.

FIG. 4A depicts a schematic of a first setting mechanism 400 according to one or more embodiments.

The first setting mechanism can have an extension 302. The first setting mechanism can have a solid end 305. The solid end 305 can be used to isolate zones in a wellbore.

The first setting mechanism 400 can have a load shoulder 301. The load shoulder 301 and the extension 302 can support the removable nose cone.

The first setting mechanism 400 can have a one or more engaging threads 393 formed on an outer diameter thereof.

A first bridge plug setting mechanism chamber 309 can be formed in the bridge plug 400. The first bridge plug setting mechanism chamber 309 can have a first diameter. A second bridge plug setting mechanism chamber 311 can also be formed in the bridge plug. The second bridge plug setting mechanism chamber can have a second diameter.

The first diameter can be less than the second diameter creating a stop shoulder 307 to allow the seating of a setting tool. The second bridge plug setting mechanism chamber can have shear threads 313 to engage with the setting tool.

Figure 4B:
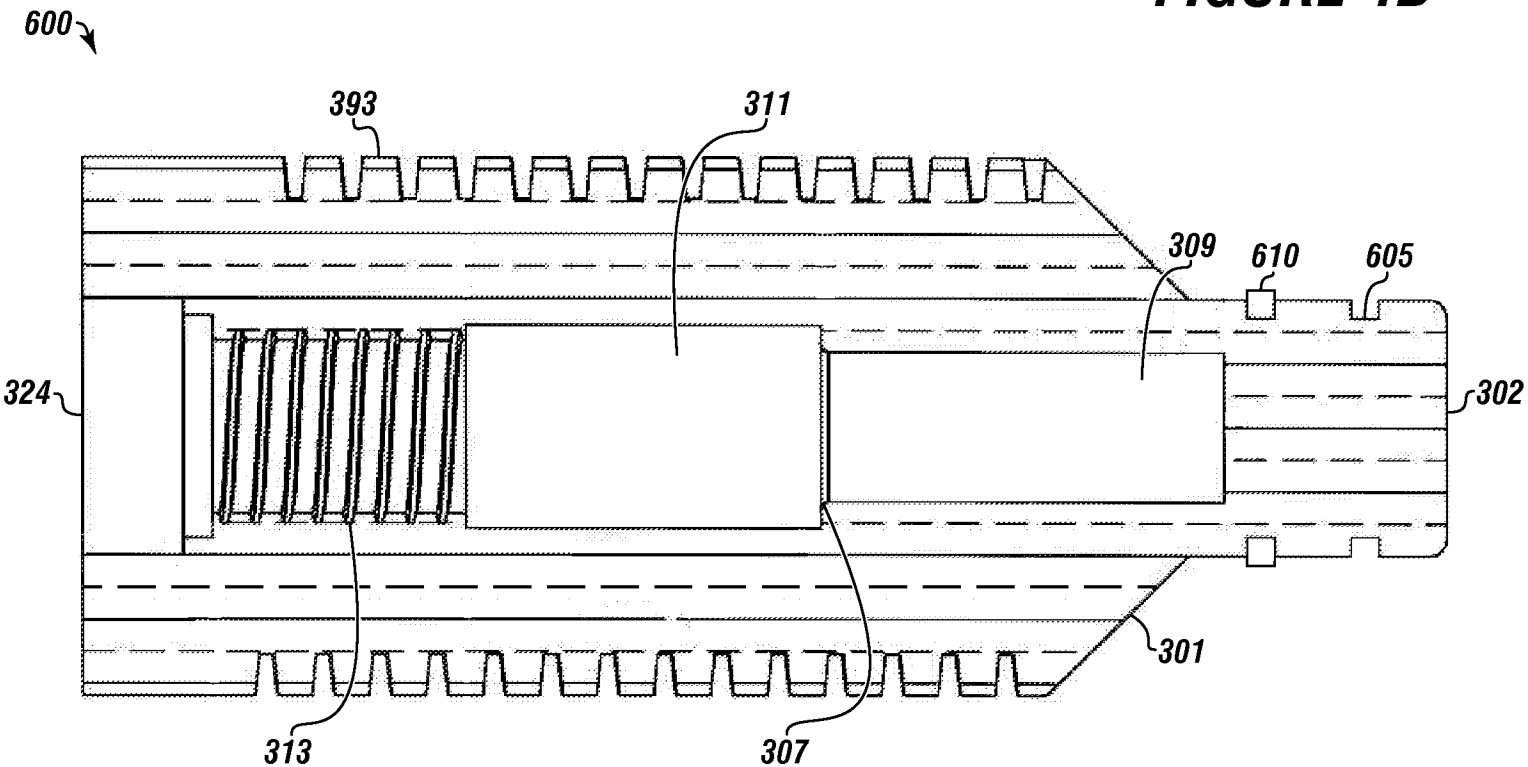
FIG. 4B depicts a schematic of a second setting mechanism.

FIG. 4B depicts a schematic of a second setting mechanism 600.

The second setting mechanism 600 can include the extension 302. The extension 302 can have one or more seal grooves 605. The seal grooves 605 can support one or more seals 610.

The second setting mechanism 600 can have the first bridge plug setting mechanism chamber 309 and the second bridge plug setting mechanism chamber 311 formed therein. The second setting mechanism 600 can have one or more shear threads 313 formed on an inner diameter of the second chamber 311.

The second setting mechanism 600 can include a load shoulder 301. The second setting mechanism 600 can also have one or more engaging threads 393 formed on an outer diameter thereof.

The second setting mechanism 600 can also include a tightening groove 324. The second setting mechanism 600 can be engaged with the second setting mechanism receiving portion.

The second setting mechanism 600 can include the shoulder 307 that acts like a setting tool stop on the bridge.

Figure 4C:
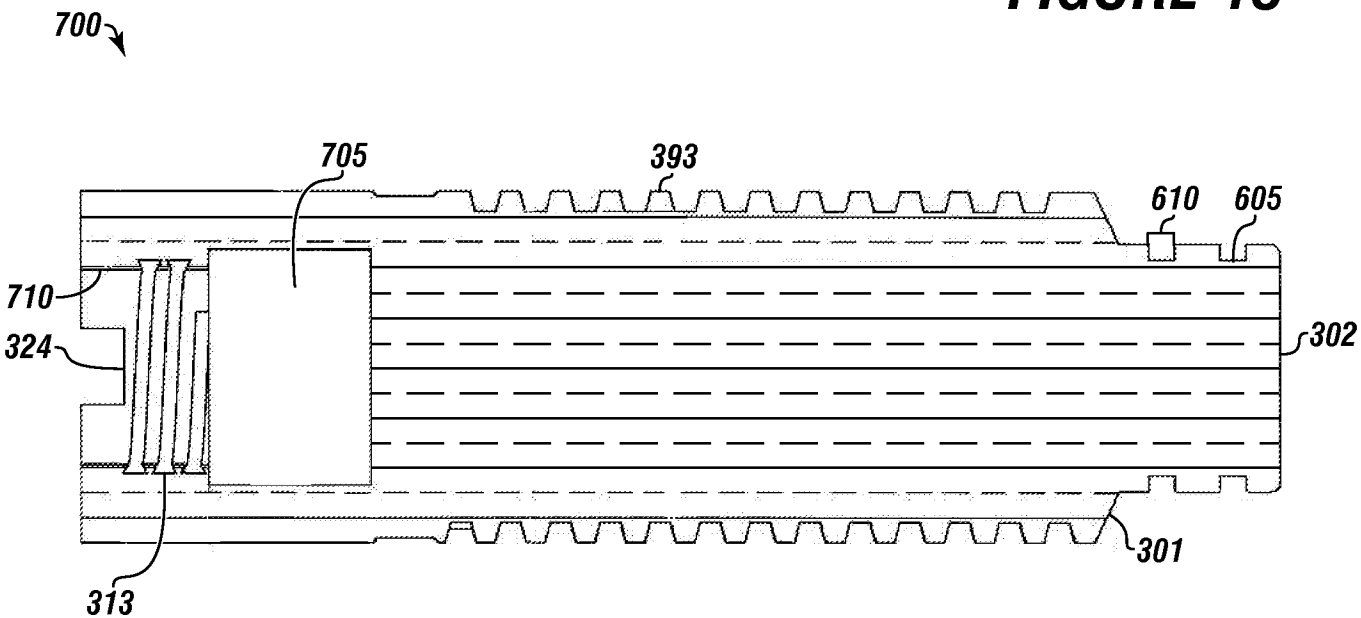
FIG. 4C depicts a schematic of a third setting mechanism.

FIG. 4C depicts a schematic of a third setting mechanism 700.

The third setting mechanism 700 can have the extension 302. The extension 302 can have one or more seal grooves 605. The seal grooves 605 can support one or more seals 610.

The third setting mechanism 700 can include a load shoulder 301. The third setting mechanism 700 can also have one or more engaging threads 393 formed on an outer diameter thereof. The third setting mechanism 700 can also include a tightening groove 324.

The third setting mechanism 700 can include a threaded chamber 710 that can have one or more shear threads 313 formed on an inner diameter thereof. The third setting mechanism 700 can include an additional chamber 705.

Figure 5:
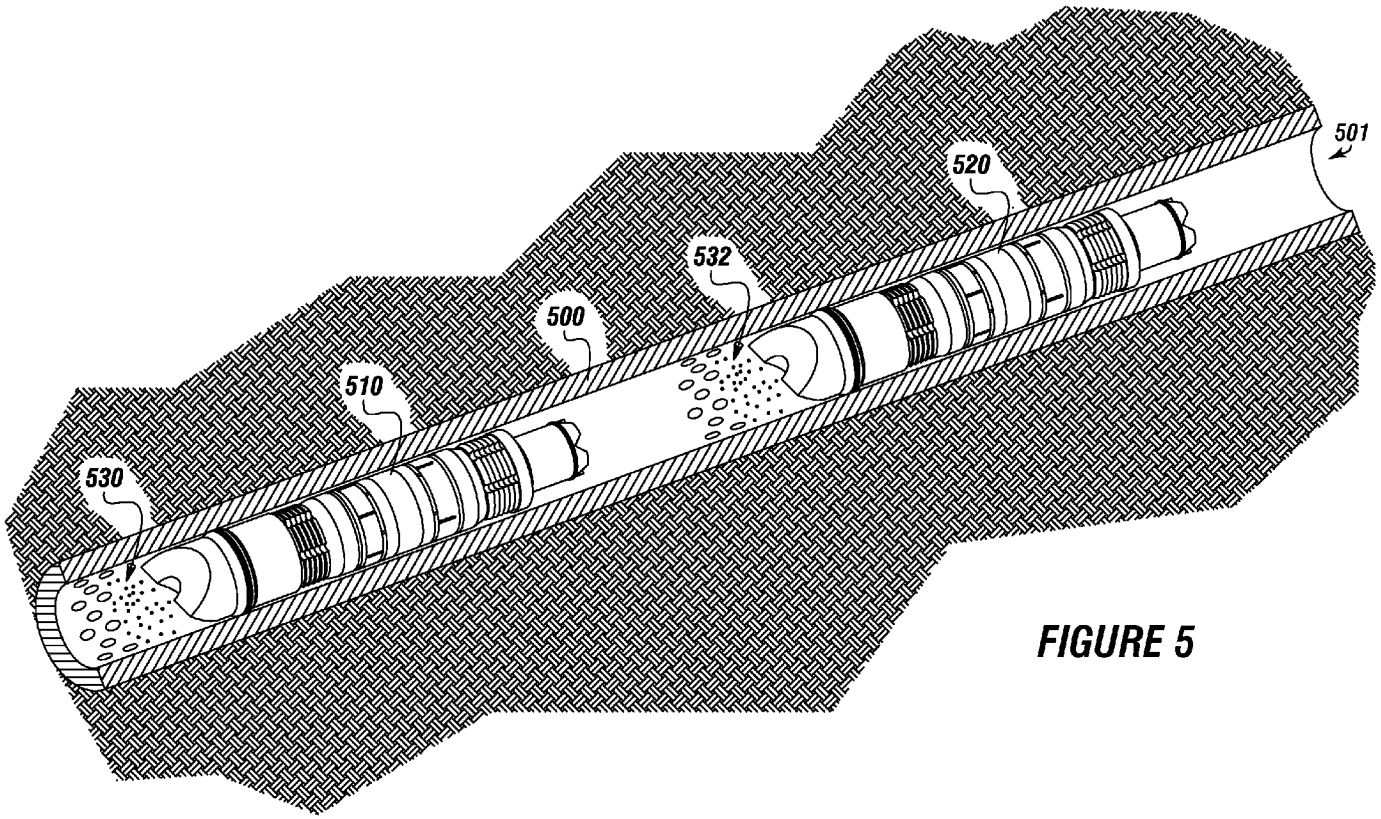
FIG. 5 depicts a schematic of two fractionation plugs disposed within a wellbore.

FIG. 5 is a schematic of two fractionation plugs disposed within a wellbore 501.

As depicted, the wellbore 501 can have a perforated casing 500 and two hydrocarbon bearing zones 530 and 532.

The embodiments of the fractionation plug described herein can be used within casing or within production tubing. For example, in one or more embodiments, the fractionation plug can be used within the wellbore casing.

In operation, coil tubing, wire lines, or other devices, which are not shown, can be used to place the fractionation plugs 510 and 520 into the wellbore 501. The fractionation plugs 510 and 520 can isolate the hydrocarbon bearing zones 530 and 532 from one another.

Once the plug is at a designated location, the setting tool can pull the mandrel, holding the outer components on the mandrel, which can compress the outer components, the slips, and the slip backups for engagement with the casing of the wellbore.

Once the plug is set in place, completion or workover operations can be performed.

FIG. 6 depicts a cross sectional view of a load ring disposed about a mandrel wherein one or more set screws are disposed through the load ring. The load ring 380 can be disposed about the mandrel 12. One or more shear pins 700*a* and 700*b* can be disposed through the load ring 380 and engage the mandrel 12. For example, the shear screws can extend $\frac{1}{8}^{th}$ of an inch into the mandrel 12. The shear pins 700*a* and 700*b* can prevent premature movement of the load ring 380.

FIG. 7 depicts a tapered nose cone having a beveled distal end. The removable nose cone 348 can have two slanted faces, one slanted face 709 is shown, and a pair of bevels 710 and 712 on a distal end thereof. The bevels 710 and 712 can be twenty degree bevels. The bevels help to reduce the risk of the removable nose cone 348 catching on a portion of a wellbore, reducing the likelihood of a premature set.

While these embodiments have been described with emphasis on the embodiments, it should be understood that within the scope of the appended claims, the embodiments might be practiced other than as described herein.

What is claimed is:

1. A bridge style fractionation plug for use in a wellbore comprising:

a. a mandrel having a crown engagement and a first setting mechanism receiving portion and a second setting mechanism receiving portion, wherein the crown engagement has a larger diameter portion with a diameter larger than the setting mechanism receiving portions, and wherein the setting mechanism receiving portions are between terminal ends of the mandrel, and wherein an anti-rotation ring is disposed on the larger diameter portion of the crown engagement;

b. a load ring disposed about the mandrel;

c. a first slip disposed adjacent to the load ring;

d. a first slip backup adjacent the first slip onto the mandrel;

e. a first lubricating spacer adjacent the first slip backup;

f. a first secondary seal adjacent the first lubricating spacer;

g. a primary seal adjacent the first secondary seal;

h. a second secondary seal adjacent the primary seal;

i. a second lubricating spacer adjacent the second secondary seal;

j. a second slip backup adjacent the second lubricating spacer;

k. a second slip adjacent the second slip backup;

l. a removable nose cone disposed over the mandrel adjacent the second slip, wherein the removable nose cone comprises:

(i) a nose cone body with an opening;

(ii) a dual tapered engagement integral with the nose cone body, wherein the tapered engagement comprises a first sloped face, and a second sloped face;

(iii) a central annulus formed between the first sloped face and the second sloped face;

(iv) a pump down ring groove formed between the nose cone body and the tapered engagement for containing a pump down ring;

(v) a plurality of pressure relief grooves extending longitudinally, with each pressure relief groove disposed on an outer surface of the nose cone body; and (vi) a facial seal formed in the setting mechanism receiving end of the mandrel;

m. wherein the mandrel is adapted to use a bridge plug configuration comprising:

(i) a first setting mechanism threadable into the first setting mechanism receiving portion, wherein the first setting mechanism comprises:

(a) a setting mechanism body engaging the facial seal;

(b) a solid end on a first end of the setting mechanism body;

(c) a load shoulder formed between the setting mechanism body and the solid end;

(d) an extension extending from the load shoulder opposite the solid end; and (e) engaging threads extending over an outer surface of the setting mechanism body engaging the internal threads of the setting mechanism receiving end, wherein the bridge plug body further comprises:

(i) a first bridge plug setting mechanism first chamber having a first diameter;

(ii) a first bridge plug setting mechanism second chamber having a second diameter, wherein the second diameter is larger than the first diameter creating a shear device shoulder; and (iii) shear threads formed on an inner surface of the second shear device chamber;

(ii) a second setting mechanism threadable into the second setting mechanism receiving portion, wherein the second setting mechanism comprises:

(a) a second setting mechanism body engaging the inner diameter of the mandrel;

(b) a second setting mechanism solid end on a second setting mechanism first end of the second setting mechanism;

(c) a second setting mechanism load shoulder formed between the second setting mechanism body and the second setting mechanism solid end;

(d) a second setting mechanism extension extending from the second setting mechanism load shoulder opposite the second setting mechanism solid end, wherein the second setting mechanism extension has a plurality of O-ring grooves, wherein the O-ring grooves have O-rings disposed therein; and (e) second setting mechanism engaging threads extending over an outer surface of the second setting mechanism body engaging internal threads of the second setting mechanism receiving portion, wherein the second setting mechanism body further comprises:

(i) a second bridge plug setting mechanism first chamber having a first diameter;

(ii) a second bridge plug setting mechanism second chamber having a second diameter, wherein the second diameter is larger than the first diameter creating a shear device shoulder; and (iii) shear threads formed on an inner surface of the second shear device chamber.

2. The bridge style fractionation plug of claim 1, wherein the bridge plug comprises left handed threads on the outer surface and right handed threads on the inner surface.

3. The bridge style fractionation plug of claim 1, wherein the mandrel comprises composite material.

4. The bridge style fractionation plug of claim 1, wherein the slips are metallic composite, non-metallic composite, or combinations thereof.

5. The bridge style fractionation plug of claim 1, wherein a shear screw is disposed through the load ring and at least partially into the mandrel.

6. A bridge style fractionation plug for use in a wellbore comprising:

a. a mandrel having a crown engagement on one end, and wherein a first setting mechanism receiving portion, a second setting mechanism receiving portion, or both are formed within an inner bore of the mandrel;

b. a load ring adjacent the crown engagement;

c. a load ring disposed on the mandrel adjacent the crown engagement;

d. a first slip disposed adjacent to the load ring;

e. a first slip backup adjacent the first slip on the mandrel;

f. a first lubricating spacer adjacent the first slip backup;

g. a first secondary seal adjacent the first lubricating spacer;

h. a primary seal adjacent the first secondary seal;

i. a second secondary seal adjacent the primary seal;

j. a second lubricating spacer adjacent the second secondary seal;

k. a second slip backup adjacent the second lubricating spacer;

l. a second slip adjacent the second slip backup; and m. a tapered nose cone connected with the mandrel, wherein the tapered nose cone comprises two slanted faces.

7. The bridge style fractionation plug of claim 6, wherein a distal end of the tapered nose cone is beveled.

* * * * *